US005152801A

United States Patent [19]

Altermatt et al.

[11] Patent Number: 5,152,801

[45] Date of Patent: * Oct. 6, 1992

[54] PROCESS FOR DYEING LEATHER WITH AN AQUEOUS BATH CONTAINING SULFONATED CARBON BLACK AND BLACK ANIONIC DYE

[75] Inventors: Hans Altermatt, Reinach; Alois Püntener, Rheinfelden; Peter Moser, Binningen; Ernst Tempel, Riehen, all of Switzerland

[73] Assignee: Ciba-Geigy Corporation, Ardsley, N.Y.

[ * ] Notice: The portion of the term of this patent subsequent to Apr. 16, 2008 has been disclaimed.

[21] Appl. No.: 622,888

[22] Filed: Dec. 5, 1990

[30] Foreign Application Priority Data

Dec. 11, 1989 [CH] Switzerland ..... 4438/89

[51] Int. Cl.[5] ..... D06P 1/30

[52] U.S. Cl. ..... 8/436; 8/437; 8/637.1; 8/640; 8/681; 8/685; 8/916; 106/473

[58] Field of Search ..... 8/404, 436, 437, 637.1, 8/640, 681, 685, 916; 106/473

[56] References Cited

U.S. PATENT DOCUMENTS

| | | | |
|---|---|---|---|
| 3,528,840 | 9/1970 | Aboytes | 106/307 |
| 3,660,133 | 5/1972 | Van Der Schuyt | 106/307 |
| 4,525,169 | 6/1985 | Higuchi et al. | 8/485 |
| 4,941,886 | 7/1990 | Poletto | 8/637.1 |
| 5,007,941 | 4/1991 | Martinelli et al. | 8/437 |

FOREIGN PATENT DOCUMENTS

| | | |
|---|---|---|
| 1371975 | 10/1974 | United Kingdom . |
| 1545681 | 5/1979 | United Kingdom . |
| 2208393 | 3/1988 | United Kingdom . |

OTHER PUBLICATIONS

93:221927 Chem. Abstr (1980).
Chem. Abstr., 97:146510r (1982).
Chem. Abstr. 107:60955c (1987).
Derwent Abstract #088495-D (1971).
Derwent Abstract #70524T-AD (1970).
Derwent Abstract #86-019409/3 (1985).
AX Derwent Abstract #74-76430v.
Bradley A Swope May 13, 1991.

*Primary Examiner*—A. Lionel Clingman
*Assistant Examiner*—Bradley A. Swope
*Attorney, Agent, or Firm*—Marla J. Mathias; Edward McC.Roberts

[57] ABSTRACT

There is disclosed a process for dyeing leather by the exhaust process, which comprises treating leather with an aqueous liquor which contains a formulation comprising a black anionic dye and a sulfonated carbon black. The leather dyeings obtained by this process have good allround fastness properties.

20 Claims, No Drawings

PROCESS FOR DYEING LEATHER WITH AN AQUEOUS BATH CONTAINING SULFONATED CARBON BLACK AND BLACK ANIONIC DYE

The present invention relates to a process for dyeing leather and to dye formulations suitable therefor.

It is already known in the art to coat leather with compositions which contain an anionic dye, an inorganic pigment, and a suitable binder, for example an acrylic resin. When applied, for example by spraying, the coloured formulation forms a film on the surface of the leather.

Surprisingly, it has now been found that formulations comprising substantially a black inorganic dye and a modified carbon black are excellently suited to dyeing leather by the exhaust process.

Accordingly, the invention relates to a process for dyeing leather by the exhaust process, which comprises treating leather with an aqueous liquor which contains a formulation comprising a black anionic dye and a sulfonated carbon black.

Suitable black anionic dyes are all dyes customarily used in leather dyeing. Preferred dyes are acid dyes and direct dyes, especially sulfonated monoazo, disazo and polyazo dyes as well as metal complex dyes.

In addition to dyes of a black hue, black dyes will be understood as comprising, for example, also dyes having a dark blue, bluish-grey or yellowish-, reddish- or greenish-black hue.

A group of particularly suitable black anionic dyes is that of formula

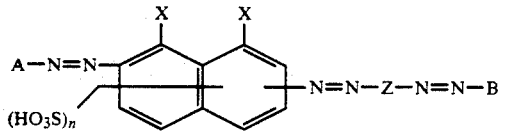

(1)

wherein one X is hydroxy and the other X is amino or hydrogen, A is an unsubstituted or a substituted phenyl or naphthyl radical, B is a phenyl or naphthyl radical containing at least one amino and/or hydroxyl group as well as further optional substituents, Z is a radical of formula

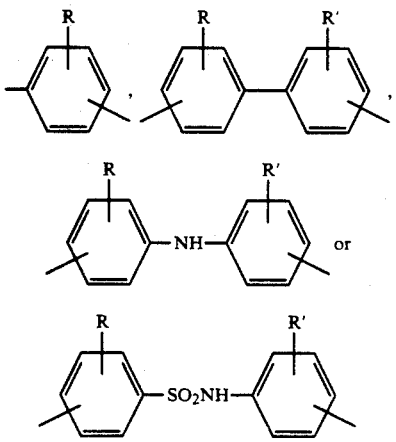

and R and R' are each independently of the other hydrogen, sulfo, $C_1$–$C_4$alkyl or $C_1$–$C_4$alkoxy, and n is 1 or 2.

The phenyl or naphthyl radical A may contain one or more identical or different substituents, for example $C_1$–$C_4$alkyl, which here and throughout this specification will generally be understood as meaning methyl, ethyl, n-propyl or isopropyl, or n-butyl, isobutyl, sec-butyl or tert-butyl; $C_1$–$C_4$alkoxy, which will generally be understood as meaning methoxy, ethoxy, n-propoxy or isopropoxy, or n-butoxy, isobutoxy, sec-butoxy or tert-butoxy; halogen, for example fluoro, bromo and, preferably, chloro; trifluoromethyl; $C_1$–$C_4$alkylsulfonyl, preferably methylsulfonyl or ethylsulfonyl; sulfamoyl, for example —$SO_2NH_2$, or N-monoalkylaminosulfonyl or N,N-dialkylaminosulfonyl, each containing 1 to 4 carbon atoms in the alkyl moiety or moieties, respectively; carbamoyl, for example —$CONH_2$, or N-monoalkylaminocarbonyl or N,N-dialkylaminocarbonyl, each containing 1 to 4 carbon atoms in the alkyl moiety or moieties, respectively; sulfo; nitro; cyano; carboxy; phenoxy.

Preferably A is phenyl or phenyl which is substituted by halogen, nitro, sulfo, $C_1$–$C_4$alkyl and/or $C_1$–$C_4$alkoxy.

In addition to amino and hydroxy, the phenyl or naphthyl radical B may carry further substituents, for example a N-monoalkylamino or N,N-dialkylamino radical, each containing 1 to 4 carbon atoms in the alkyl moiety or moieties, respectively, a phenylamino, o-, m- or p-methylphenylamino radical, or a benzoylamino, $C_1$–$C_4$alkanoylamino or carboxymethylamino radical, each unsubstituted or substituted, for example, by methyl, chloro or nitro, or one of the substituents cited previously for A.

Preferably B is a phenyl radical which carries a hydroxy or amino group and a further substituent selected from the group consisting of hydroxy, amino, phenylamino, o-, m- or p-methylphenylamino, $C_1$–$C_4$alkoxy and phenoxy.

Most preferably B is the radical of 1,3-dihydroxybenzene, 1,3-diaminobenzene or 3-aminophenol.

R and R' are each independently of the other preferably hydrogen, methyl, methoxy or sulfo.

Preferred radicals Z are:

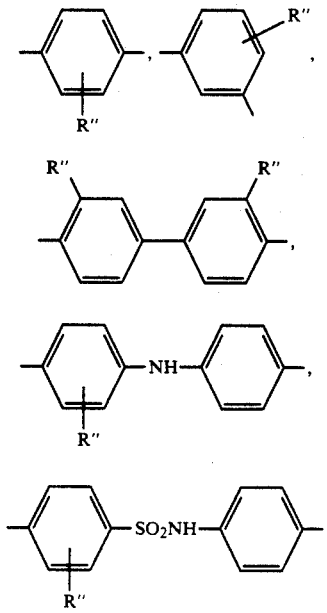

wherein

R'' is, for example, hydrogen, methyl, methoxy or sulfo.

n is preferably 2.

The naphthol coupling component present in the black anionic dyes of formula (1) is, for example, 2-amino-5-naphthol-7-sulfonic acid (I acid), 1-amino-8-naphthol-4,6-disulfonic acid (K acid) or, preferably, 1-amino-8-naphthol-3,6-disulfonic acid (H acid).

A particularly preferred group of black anionic dyes for use in the process of this invention is that of formula

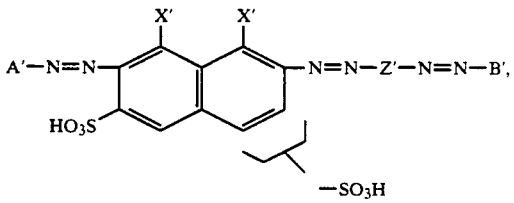

(1a)

wherein A' is phenyl or phenyl which is substituted by halogen, nitro, sulfo, $C_1$–$C_4$alkyl and/or $C_1$–$C_4$alkoxy, B' is a phenyl radical which carries a hydroxyl or amino group and a further substituent selected from the group consisting of hydroxy, amino, phenylamino, o-, m- or p-methylphenylamino, $C_1$–$C_4$alkoxy and phenoxy, Z' is a radical of formula

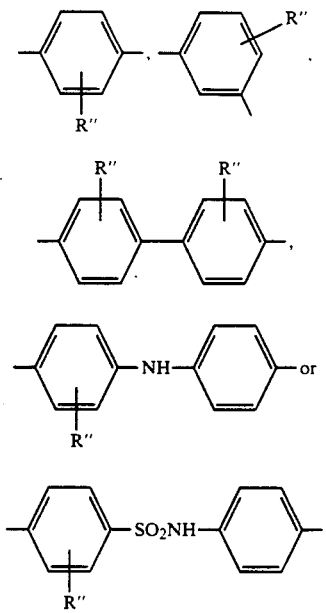

wherein R'' is as previously defined, and one X' is hydroxy and the other X' is amino.

Illustrative of especially preferred black dyes of formula (1) are

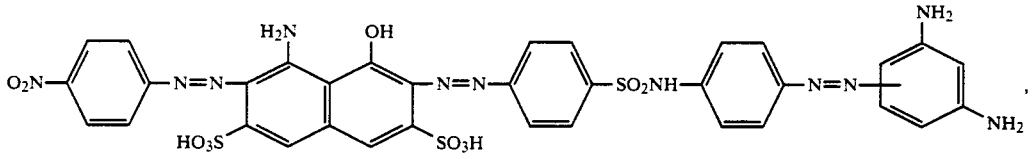

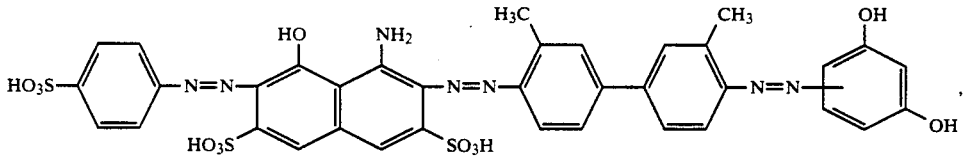

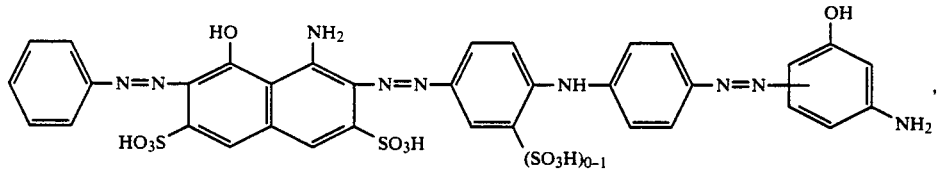

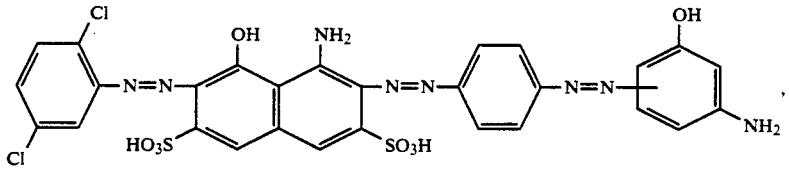

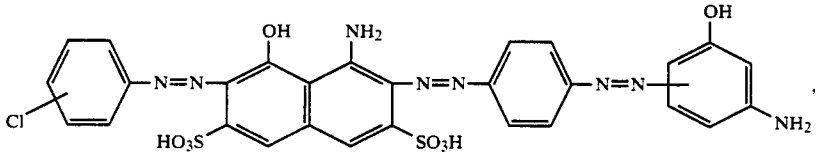

-continued

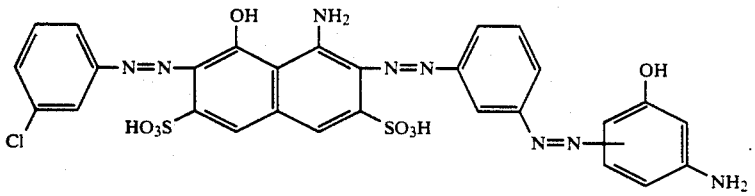

The dyes of formulae (1) and (1a) are known per se or can be obtained in a manner known per se.

A further group of suitable anionic dyes comprises metallised monoazo, disazo or polyazo dyes as well as azomethine dyes. The anionic character of these dyes may be imparted to them by metal complexing alone and/or by acid salt-forming substituents such as carboxylic acid groups, phosphonic acid groups and, in particular, by sulfonic acid groups. The 1:1 or 1:2 metal complex dyes are preferred. The 1:1 metal complexes contain preferably one or two sulfonic acid groups and typically a copper, nickel, iron or, especially, a chromium atom as heavy metal.

The 1:2 metal complex dyes contain a heavy metal atom as central atom, for example an iron, cobalt or, preferably, a chromium atom. Two complexing components are attached to the central metal atom, at least one of which components is a dye molecule; but preferably both components are dye molecules. Further, the two complexing dye molecules may be identical or different. The 1:2 metal complex dyes may contain, for example, two azomethine molecules, one azo and one azomethine dye or, preferably, two azo dyes, which dyes may be substituted by further arylazo and/or arylazoaryleneazo groups. Aryl will be understood as meaning here preferably benzene or naphthalene radicals which may be substituted, for example by nitro, sulfo, halogen, $C_1$–$C_4$alkyl or $C_1$–$C_4$alkoxy. The azo or azomethine dye molecules may contain water-solubilising groups, for example carbamoyl, $C_1$–$C_4$alkylsulfonyl or the acid groups mentioned above. Preferred 1:2 metal complexes are 1:2 cobalt or 1:2 chromium complexes of monoazo or disazo dyes which contain sulfonic acid groups.

The black complex dyes which are particularly suitable for the process of this invention are in the form of the free acid of formula

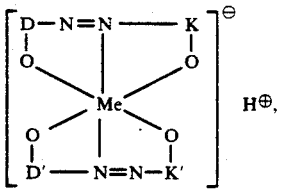

(2)

wherein D and D′ are each independently of the other a benzene or naphthalene radical which may or may not be further substituted and which carries a hydroxyl group ortho to the azo group, K and K′ are each independently of the other the radical of a coupling component of the benzene or naphthalene series which carries a hydroxyl group ortho to the azo group and which may or may not be further substituted, and Me is chromium or cobalt.

Suitable dyes of formula (2) are symmetrical as well as asymmetrical 1:2 metal complexes. Me in formula (2) is preferably chromium.

Preferably D and D′ are each independently of the other a phenyl or naphthyl radical, each unsubstituted or substituted by sulfo, nitro, $C_1$–$C_4$alkylsulfonyl, $C_1$–$C_4$alkyl, halogen, sulfamoyl, N-monoalkylaminosulfonyl or N,N-dialkylaminosulfonyl, each containing 1 to 4 carbon atoms in the alkyl moiety or moieties, respectively, and/or phenylazo which may itself be substituted in the phenyl moiety by $C_1$–$C_4$alkyl, $C_1$–$C_4$alkoxy, sulfo, nitro or halogen.

The radicals D and D′ may be derived, for example, from the following compounds: anthranilic acid, 4- or 5-sulfo-2-aminophenol, 4- or 5-nitro-2-aminophenol, 4-nitro-6-sulfo-2-aminophenyl, 6-nitro-4-sulfo-2-aminophenol, 4-chloro-5-nitro-2-aminophenol, 4-methyl-2-aminophenol, 6-chloro-4-sulfo-2-aminophenol, 4-chloro-6-sulfo-2-aminophenyl, 4-chloro- or 4-methyl-6-nitro-2-aminophenol, 4-chloro-2-aminophenol, 4-methylsulfonyl-2-aminophenol, 4-(2-methoxyphenylazo)-2-aminophenol, 4-(2-, 3- or 4-sulfophenylazo)-2-aminophenol, 4-phenylazo-2-aminophenol, 1-amino-2-hydroxynaphthalene-4-sulfonic acid, 1-amino-2-hydroxy-6-nitronaphthalene-4-sulfonic acid.

Most preferably, D and D′ are each independently of the other the radical of a 2-aminophenol which is unsubstituted or substituted by one or more identical or different members selected from the group consisting of nitro, sulfo, chloro, methyl, methoxy, methylsulfonyl, sulfamoyl and phenylazo which may itself be substituted in the phenyl moiety by sulfo, methyl, methoxy, nitro or chloro, or are the radical of a 1-amino-2-hydroxynaphthalene which may be substituted by sulfo and/or nitro.

K and K′ may be a phenol or 1- or 2-naphthol radical which is unsubstituted or substituted, for example, by amino, hydroxy, $C_1$–$C_4$alkoxy, $C_1$–$C_4$alkyl, sulfamoyl, N-monoalkylaminosulfonyl or N,N-dialkylaminosulfonyl, each containing 1 to 4 carbon atoms in the alkyl moiety or moieties, respectively, $C_1$–$C_4$alkanoylamino, for example acetylamino or benzoylamino, sulfo, halogen or phenylazo which may itself be substituted in the phenyl moiety by $C_1$–$C_4$alkyl, $C_1$–$C_4$alkoxy, sulfo, nitro or halogen.

Illustrative of suitable coupling components from which the radicals K and K′ may be derived are: 1-naphthol, 2-naphthol, 1,3- or 1,5-dihydroxynaphthalene, 2-hydroxy-8-acetylaminonaphthalene, 2-naphthol-3-, -4-, -5-, -6-, -7- or -8-sulfonic acid, resorcinol, 3-dimethylaminophenol or 3-diethylaminophenol, phenylazoresorcinol, o-, m- or p-chlorophenylazoresorcinol, bis(o-, m- or p-chlorophenylazo)resorcinol.

Preferably K and K′ are each independently of the other a 1- or 2-naphthol radical which is unsubstituted or substituted by hydroxy, amino, sulfo, sulfamoyl or acetylamino, or are an unsubstituted resorcinol radical or a resorcinol radical which is substituted by phenylazo which may itself be substituted in the phenyl moiety by methyl, methoxy, chloro, sulfo or nitro.

The complex dyes of formula (2) contain, for example, 0 to 4, preferably 1 to 4 and, most preferably, 1 or 2 sulfo groups.

Particularly preferred complex dyes for use in the process of this invention are black complex dyes which are in the form of the free acid of formula

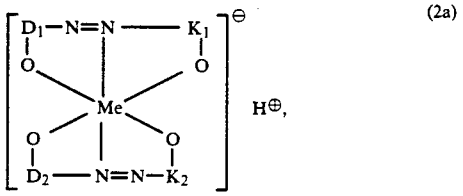

(2a)

wherein $D_1$ and $D_2$ are each independently of the other the radical of a 1-amino-2-hydroxynaphthalene which is unsubstituted or substituted by sulfo and/or nitro, or are the radical of a 2-aminophenol which is unsubstituted or substituted by nitro, sulfo, chloro, methyl, methoxy, methylsulfonyl or phenylazo which may itself be substituted in the phenyl moiety by sulfo, methyl, methoxy, nitro or chloro, and $K_1$ and $K_2$ are each independently of the other a 1- or 2-naphthol radical which is unsubstituted or substituted by hydroxy, amino, sulfo or acetylamino, or are a resorcinol radical which is unsubstituted or substituted by phenylazo which may itself be substituted in the phenyl moiety by methyl, methoxy, chloro, sulfo or nitro, and wherein the complex dye contains one or two sulfo groups.

Illustrative of preferred black complex dyes are:

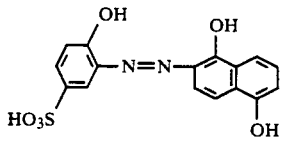

1:2 chromium complex

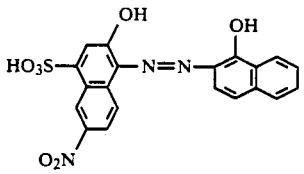

1:2 chromium complex

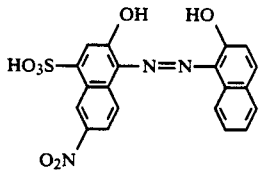

1:2 chromium complex

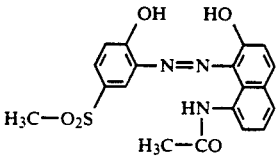

1:2 chromium complex

-continued

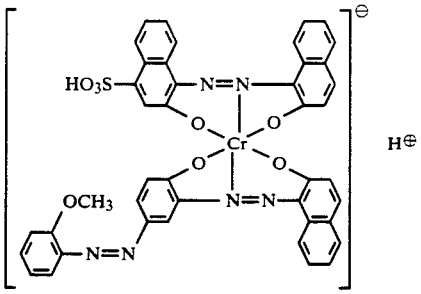

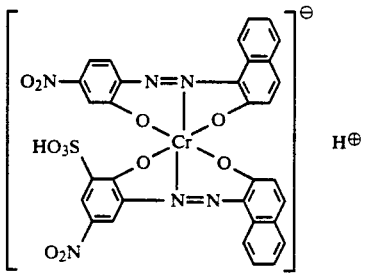

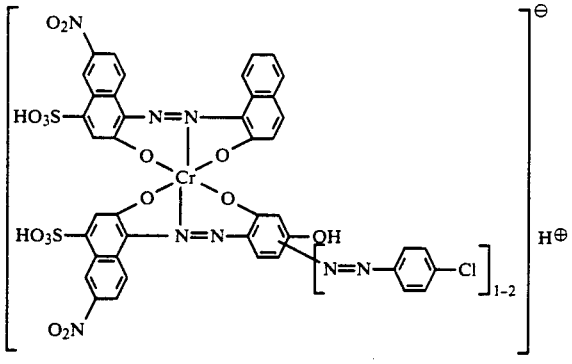

The metal complex compounds of formula (2), which are conveniently used in the form of their salts, preferably alkali metal salts such as lithium, potassium and, most preferably, sodium salts or also ammonium salts, are known per se or can be obtained in a manner which is known per se.

Suitable sulfonated carbon blacks are disclosed, for example, in U.S. Pat. No. 3,528,840 or in German Offenlegungsschrift 1 927 597, or they can be prepared by methods analogous to those described therein. These carbon blacks are pigments in which the sulfo groups are chemically and/or physically bonded, so that they cannot be removed by washing with water. The sulfonated carbon blacks used in the process of this invention conveniently have a sulfur content of, for example, 0.5 to 6% by weight and, preferably, of 1 to 3% by weight, as well as an acid pH value, i.e. below 7 and preferably in the range from 1 to 5. The pH of the carbon black will be understood as meaning in this context the pH of a suspension of the carbon black in distilled water.

The sulfonated carbon blacks can be obtained, for example, in analogy to U.S. Pat. No. 3,528,840 by heating a customary carbon black—suitable are all types of carbon black and especially those having an average particle size of 10 to 100 nm, preferably 20 to 50 nm—together with ammonium sulfite or, preferably, ammonium sulfate, to a temperature above 230° C., preferably to a temperature in the range from 250° to 300° C., with stirring. The amount of ammonium sulfite or ammonium sulfate required depends on the desired pH and sulfur content of the sulfonated carbon black, but is ordinarily from 1 to 20% by weight, preferably from 2 to 15% by weight and, most preferably, from 5 to 12% by weight, based on the weight of the carbon black employed.

It is also possible to obtain suitable sulfonated carbon blacks in analogy to German Offenlegungsschrift 1 927 597 by reacting a customary carbon black as previously defined, in the dry state, with gaseous sulfur trioxide ($SO_3$) at elevated temperature, for example in the range from 100° to 300° C. and preferably from 150° to 200° C.

The procedure comprises passing $SO_3$ into the carbon black with the aid of an inert gas such as air or nitrogen. Oleum may be used as $SO_3$ donor, and nitrogen is then blown in through the oleum, for example such that the $SO_3$ is carried by the nitrogen. The introduction of $SO_3$ and nitrogen into the reactor, in which the carbon black is stirred at the reaction temperature, is discontinued as soon as the desired amount of $SO_3$ has been introduced. The pH of the carbon black can be used to determine the required amount of $SO_3$. This is done by taking samples of carbon black in the course of the reaction, determining their pH, and then terminating the feed of $SO_3$ when the desired pH of the carbon black has been attained.

The formulations used in the process of this invention preferably contain the black anionic dye and the sulfonated carbon black in a weight ratio of typically 95:5 to 60:40, preferably 90:10 to 70:30 and, most preferably, 80:20 to 75:25. It is also possible to use formulations of different anionic dyes and/or carbon blacks. The formulations may additionally contain a dust inhibitor, for example a dust oil.

Preferred formulations for the process of this invention are those which contain a black dye of formula (1) or (2) as indicated above and a sulfonated carbon black having a sulfur content of 0.5 to 6% by weight.

A particularly preferred embodiment of the invention comprises using a dye formulation containing a black anionic dye of formula (1a) or (2a) as indicated above and a sulfonated carbon black having a sulfur content of 1 to 3% by weight in the weight ratio of 90:10 to 70:30 and, preferably, of 80:20 to 75:25.

The above formulations, which consist substantially of a black anionic dye and a sulfonated carbon black, are novel and likewise constitute a further object of this invention.

They can be prepared, for example, by mechanically mixing the components in a suitable mixing device, for example a ball or pin mill, or in a kneader or mixer.

The process of this invention is conveniently carried out such that the leather to be dyed is first subjected to a pretreatment, for example a retanning, neutralising and/or fulling process.

The pretreated leather is then dyed by a known exhaust process using one of the dye formulations described above. For example, the leather is dyed in an aqueous solution at a liquor ratio of 1:1.5 to 1:20, preferably of 1:2 to 1:10, and at a temperature in the range from, for example, 20° to 100° C., preferably 40° to 60° C. Depending on the type of leather to be dyed, 0.25 to 15.0% by weight, preferably 1.0 to 10.0% by weight, of the respective dye formulation, based on the weight of the leather, will be used. The dyeing time will also depend on the type of the leather to be dyed, but is normally, for example, from 20 to 180 minutes.

Before, during or after dyeing, further conventional auxiliaries such as wetting agents, levelling agents, colour intensifiers and/or fatliquoring agents can be added to the dyebath. At the end of the dyeing procedure, acidification will conveniently be effected with, for example, formic acid for better bath exhaustion, and the liquor is allowed to continue circulating for a time. In some cases it may be expedient to dye the leather once more with a further portion of the dye formulation in a fresh bath. The dyed leather is finished in a manner which is known per se.

The dyeing process of this invention is suitable for all types of leather, for example grained and rough grained leather, chrome leather, retanned leather or suède leather made from goatskin, sheepskin, cowhide and pigskin. Level, deep dyeings of good opacity and good allround fastness properties such as fastness to water, washing, perspiration, dry cleaning, acid, alkali, solvents, rubbing and diffusion resistance to soft PVC are obtained. The outstanding lightfastness of the dyeings obtainable by the process of this invention merits special mention.

The invention is illustrated by the following non-limitative Examples in which parts and percentages are by weight.

Preparation of the Sulfonated Carbon Blacks

Example 1: 50 parts of carbon black (ASTM Specification N 330, average particle size 26–30 nm) and 5 parts of ammonium sulfate are milled and mixed for 5 hours in a steel ball mill. With gentle stirring, the milled material is then heated in a steel vessel to 280°–290° C. and kept for 1 hour at this temperature. After cooling, the treated carbon black is degassed for 4 hours at 80° C. under vacuum. The sulfonated carbon black has a sulfur content of 2.7% by weight.

Example 2: 25 parts of carbon black (ASTM Specification N 330, average particle size 26–30 nm) are heated, with gentle stirring, to 175° C. Then a stream of nitrogen is slowly introduced over 6 hours into the flask, which stream has been blown beforehand through 50 parts by volume of 66% oleum at 50° C. The treated carbon black is subsequently degassed for 4 hours at 80° C. under vacuum, after which treatment it has a sulfur content of 2.9% by weight.

Production of the Dyeings

Examples 3–18: 100 parts of sheepskin nappa leather, which have been subjected to an intermediate drying, are pretreated for 60 minutes at 50° C. in a liquor prepared from 1000 parts of water, 2 parts of a nonionic wetting agent (polyethylene glycol ether derivative) and 1 part of 24% ammonia, and then thoroughly rinsed.

The pretreated leather is subsequently dyed for 30 minutes at 50° C. in a fresh liquor consisting of 500 parts of water and 5 parts of one of the dye formulations listed in the Table. Then 8 parts of a fatliquoring agent consisting of 2 parts of sulfonated marine animal oil, 2 parts of a mixture of sulfonated fatty acid esters and animal fats, and 4 parts of mixture of sulfonated natural oils and animal fats are added. After a further 60 minutes, the bath is acidified with 4 parts of 85% formic acid (pH ca. 3.2) and the treatment is continued for 20 minutes. Then 2 parts of a cationic colour intensifier (quaternary polyadduct of amine/ethylene oxide) are added and the liquor is allowed to continue circulating for another 20 minutes.

Dyeing is again carried out for 30 minutes at 50° C. in a fresh bath with 5 parts of the above dye formulation in 500 parts of water. To the dyebath are then added 3 parts of a nonionic synthetic fatliquoring agent (fatty acid/polyamide condensate) and, after a further 20 minutes, 1 part of 85% formic acid. After a final treatment time of 20 minutes, the leather is rinsed and finished in conventional manner. Level, deep, black dyeings of good allround fastness properties are obtained.

TABLE

| Example | Dye formulation Black dye | Sulfonated carbon black | Weight ratio of dye/carbon black |
|---|---|---|---|
| 3 | 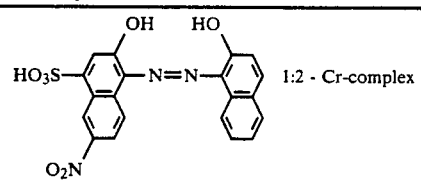 1:2 - Cr-complex | according to Example 1 | 80:20 |
| 4 | 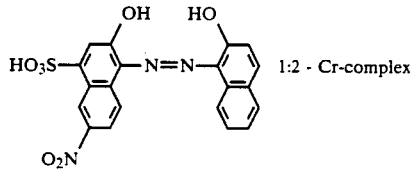 1:2 - Cr-complex | according to Example 1 | 70:30 |
| 5 | 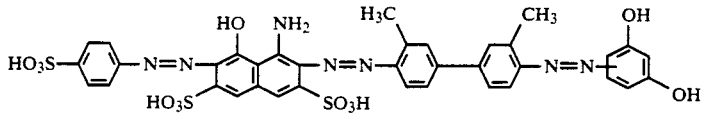 | according to Example 1 | 80:20 |
| 6 | 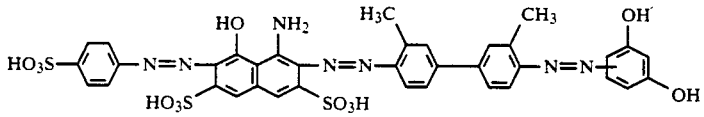 | according to Example 1 | 70:30 |
| 7 | 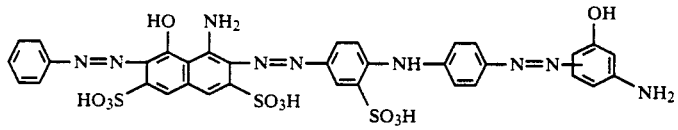 | according to Example 1 | 60:40 |
| 8 | 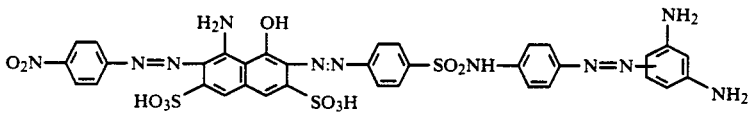 | according to Example 1 | 80:20 |
| 9 | 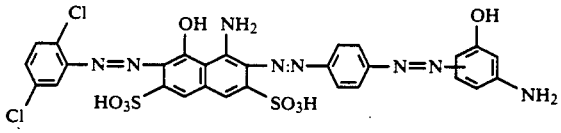 | according to Example 2 | 70:30 |
| 10 | 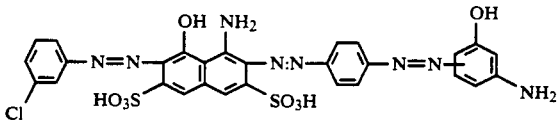 | according to Example 2 | 70:30 |
| 11 | 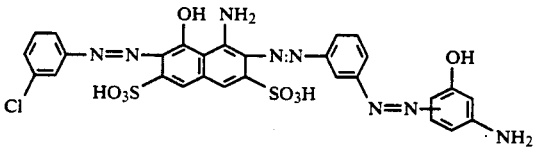 | according to Example 2 | 80:20 |
| 12 | 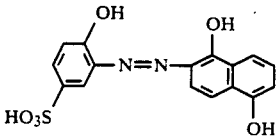 1:2 chromium complex | according to Example 2 | 90:10 |

TABLE-continued
| Example | Dye formulation Black dye | Sulfonated carbon black | Weight ratio of dye/carbon black |
|---|---|---|---|
| 13 | 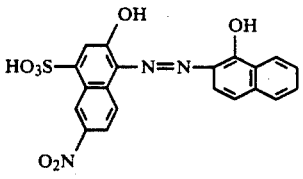 1:2 chromium complex | according to Example 2 | 80:20 |
| 14 | 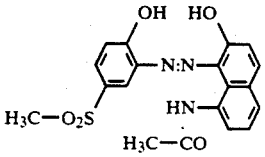 1:2 - chromium complex | according to Example 1 | 80:20 |
| 15 | 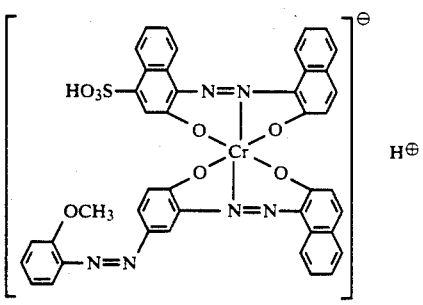 | according to Example 1 | 80:20 |
| 16 | 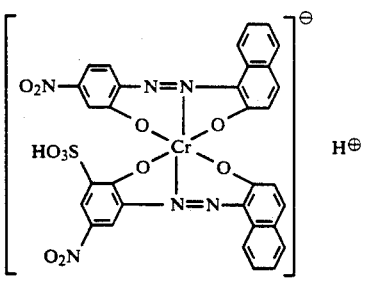 | according to Example 1 | 80:20 |
| 17 | 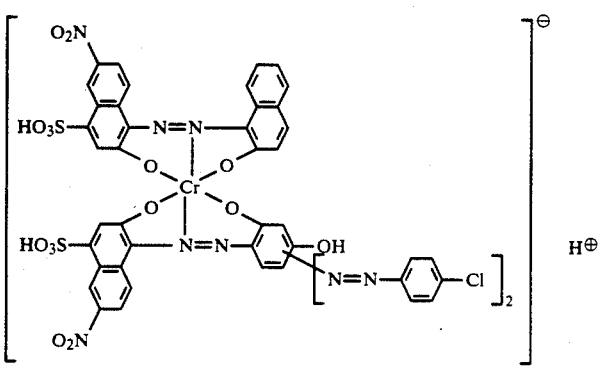 | according to Example 1 | 90:10 |

TABLE-continued

| Example | Dye formulation Black dye | Sulfonated carbon black | Weight ratio of dye/carbon black |
|---|---|---|---|
| 18 | 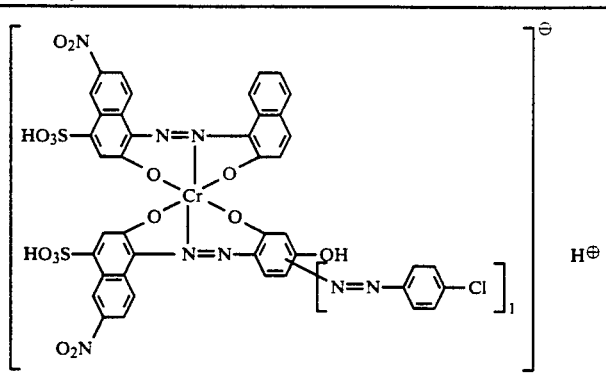 | according to Example 2 | 80:20 |

The formulations used in Examples 3 to 8 are obtained by simple mixing of the components in a mixer.

Example 19: 100 parts of chrome side leather are wetted back for 15 minutes at 30° C. in a liquor consisting of 200 parts of water, 1 part of sodium formate and 2 parts of an anionic wetting agent (sodium salts of aromatic sulfonic acids and aliphatic dicarbonic acids). Then 2 parts of an anionic fatliquoring agent (sulfonated marine animal oil), 2 parts of an anionic re-tanning agent (condensation product of aromatic sulfonic acids) and 1.5 parts of sodium hydrogencarbonate are added and the liquor is allowed to continue circulating for another 60 minutes.

The leather is thoroughly rinsed with warm water and is then re-tanned for 30 minutes at 40° C. in a fresh liquor consisting of 100 parts of water and 8 parts of an anionic re-tanning agent (condensation product of aromatic sulfone derivatives and dialkylol carbamide). Then 5 parts of the above mentioned anionic fatliquoring agent are added, followed after a further 60 minutes by 0.5 part of 85% formic acid, and treatment is continued for a further 15 minutes.

The pretreated leather is subsequently dyed for 30 minutes at 30° C. in a fresh liquor consisting of 100 parts of water, 0.5 part of ammonia, 1 part of a levelling agent (polyglycol ether derivative) and 2.65 parts of the dye formulation of Example 4. Then 8 parts of the above mentioned fatliquoring agent and 4 parts of a hydrophobing agent are added. After a further 60 minutes, the bath is acidified with 2.5 parts of 85% formic acid and the treatment is continued for 30 minutes.

Dyeing is again carried out for 30 minutes in a fresh bath with 1.35 parts of the above dye formulation and 0.5 part of a cationic colour intensifier (quaternary polyadduct of amine/ethylene oxide) in 200 parts of water. To the dyebath are then added 1 part of 85% formic acid and, after a further 15 minutes, 1.5 parts of a cationic fatliquoring agent (formulation based on chlorinated hydrocarbons and n-alkyl derivatives). After a final treatment time of 20 minutes, the leather is rinsed and finished in conventional manner. A level, deep, black dyeing of good allround fastness properties is obtained.

Example 20: 100 parts of shoe leather are first washed at 35° C. for 15 minutes in a liquor consisting of 300 parts of water and 0.5 part of an anionic wetting agent, and then treated at 35° C. for 30 minutes in a fresh liquor consisting of 150 parts of water and 4 parts of an anionic retanning agent (based on sodium salts of aromatic sulfonic acid and aliphatic dicarboxylic acids). Then 4.0 parts of mimosa, 5 parts of an anionic retanning agent (oxomethane condensation product of sulfone and sulfonic acid of cyclic compounds) and 2 parts of an anionic fatliquoring agent (mixture of sulfonated fatty acid esters and animal fats) are added, and the liquor is allowed to circulate for a further 30 minutes. 4 parts of the dye formulation of Example 4 are subsequently added and dyeing is carried out for 45 minutes at 35° C. Then 5 parts of the above fatliquoring agent, 3 parts of a further fatliquoring agent (formulation based on sulfonated chloroparaffin) and 150 parts of warm water of 50° C. are added. After a further 30 minutes, the liquor is acidified with 1 part of 85% formic acid and treatment is continued for 30 minutes. Dyeing is subsequently carried out again at 50° C. for 15 minutes in a fresh bath with 2 parts of the above dye formulation in 300 parts of water, 0.5 part of 85% formic acid and 1 part of a colour intensifier (quaternary polyadduct of amine/ethylene oxide). Then a further 0.5 part of 85% formic acid is added and the liquor is allowed to circulate for another 20 minutes. The leather is rinsed and finished in conventional manner. A level black dyeing of good allround fastness properties is obtained.

What is claimed is:

1. A process for dyeing leather which comprises treating leather by the exhaust process with an aqueous liquor which contains a formulation comprising a black anionic dye selected from the group consisting of acid dyes, direct dyes and metal complex dyes and a sulfonated carbon black having a sulfur content of from 0.5 to 6 percent by weight; the weight ratio of anionic dye to carbon black being from 95:5 to 60:40.

2. A process according to claim 1, wherein the black anionic dye is a dye of formula

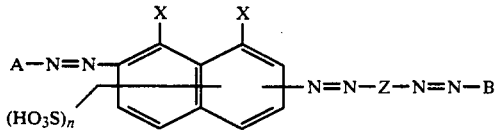

(1)

wherein one X is hydroxy and the other X is amino or hydrogen, A is an unsubstituted or a substituted phenyl or naphthyl radical, B is a phenyl or naphthyl radical containing at least one amino and/or hydroxy group as well as further optional substituents, Z is a radical of formula

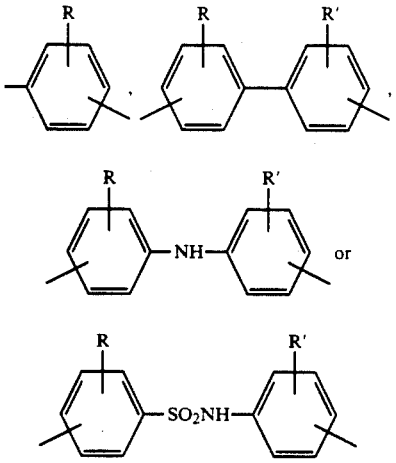

and R and R' are each independently of the other hydrogen, sulfo, $C_1$-$C_4$alkyl or $C_1$-$C_4$alkoxy, and n is 1 or 2.

3. A process according to claim 1, wherein the black anionic dye is a dye of formula

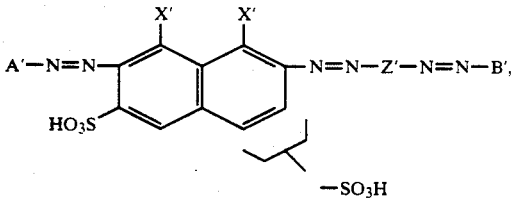

(1a)

wherein A' is phenyl or phenyl which is substituted by halogen, nitro, sulfo, $C_1$-$C_4$alkyl and/or $C_1$-$C_4$alkoxy, B' is a phenyl radical which carries a hydroxyl or amino group and a further substituent selected from the group consisting of hydroxy, amino, phenylamino, o-, m- or p-methylphenylamino, $C_1$-$C_4$alkoxy and phenoxy, Z' is a radical of formula

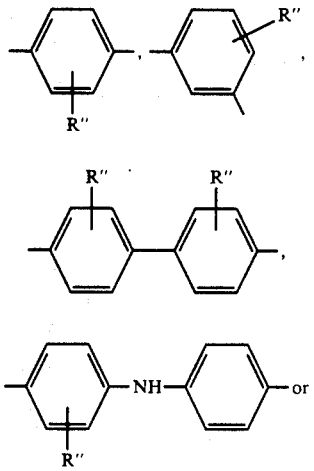

-continued

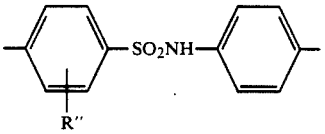

wherein R'' is hydrogen, methyl, methoxy or sulfo, and one X' is hydroxy and the other X' is amino.

4. A process according to claim 1, wherein the black anionic dye is in the form of the free acid of formula

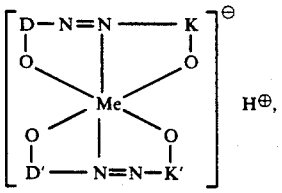

(2)

wherein D and D' are each independently of the other a benzene or naphthalene radical which may or may not be further substituted and which carries a hydroxyl group ortho to the azo group, K and K' are each independently of the other the radical of a coupling component of the benzene or naphthalene series which carries a hydroxyl group ortho to the azo group and which may or may not be further substituted, and Me is chromium or cobalt.

5. A process according to claim 1, wherein the anionic dye is a dye of formula

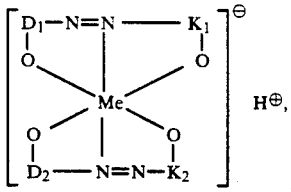

(2a)

wherein $D_1$ and $D_2$ are each independently of the other the radical of a 1-amino-2-hydroxynaphthalene which is unsubstituted or substituted by sulfo and/or nitro, or are the radical of a 2-aminophenol which is unsubstituted or substituted by nitro, sulfo, chloro, methyl, methoxy, methylsulfonyl or phenylazo which may itself be substituted in the phenyl moiety by sulfo, methyl, methoxy, nitro or chloro, and $K_1$ and $K_2$ are each independently of the other a 1- or 2-naphthol radical which is unsubstituted or substituted by hydroxy, amino, sulfo or acetylamino, or are a resorcinol radical which is unsubstituted or substituted by phenylazo which may itself be substituted in the phenyl moiety by methyl, methoxy, chloro, sulfo or nitro, and wherein the complex dye contains one or two sulfo groups.

6. A process according to claim 1, wherein the sulfonated carbon black has a sulfur content of 1 to 3% by weight.

7. A process according to claim 1, wherein the dye formulation contains the black anionic dye and the sulfonated carbon black in the weight ratio of 90:10 to 70:30.

8. A process of claim 3 wherein the sulfonated carbon black has a sulfur content of 1 to 3 percent by weight.

9. A process of claim 5 wherein the sulfonated carbon black has a sulfur content of 1 to 3 percent by weight.

10. A dye formulation comprising a black anionic dye of formula (1) according to claim 2 and a sulfonated carbon black having a sulfur content of 0.5 to 6 percent by weight; the weight ratio of anionic dye to carbon black being from 95:5 to 60:40.

11. A dye formulation comprising a black anionic dye of formula (1a) according to claim 3 and a sulfonated carbon black having a sulfur content of 0.5 to 6 percent by weight; the weight ratio of anionic dye to carbon black being from 95:5 to 60:40.

12. A dye formulation comprising a black anionic dye of formula (2) according to claim 4 and a sulfonated carbon black having a sulfur content of 0.5 to 6 percent by weight; the weight ratio of anionic dye to carbon black being from 95:5 to 60:40.

13. A dye formulation comprising a black anionic dye of formula (2a) according to claim 5 and a sulfonated carbon black having a sulfur content of 0.5 to 6 percent by weight; the weight ratio of anionic dye to carbon black being from 95:5 to 60:40.

14. A process of claim 7 wherein the weight ratio of anionic dye to carbon black is 80:20 to 75:25.

15. A process of claim 8 wherein the weight ratio of anionic dye to carbon black is 80:20 to 75:25.

16. A process of claim 9 wherein the weight ratio of anionic dye to carbon black is 80:20 to 75:25.

17. A process of claim 11 wherein the weight ratio of anionic dye to carbon black is 80:20 to 75:25.

18. A process of claim 13 wherein the weight ratio of anionic dye to carbon black is 80:20 to 75:25.

19. A dye formulation comprising a black anionic dye selected from the group consisting of acid dyes, direct dyes and metal dyes and a sulfonated carbon black having a sulfur content of 0.5 to 6 percent by weight; the weight ratio of anionic dye to carbon black being from 95:5 to 60:40.

20. A process for dyeing leather which comprises the use of a dye formulation according to claim 19.

* * * * *